US005869222A

United States Patent [19]

Twist et al.

[11] Patent Number: 5,869,222

[45] Date of Patent: Feb. 9, 1999

[54] PHOTOGRAPHIC PROCESSING SOLUTIONS

[75] Inventors: Peter Jeffery Twist, Gt. Missenden; John Demita Goddard, Pinner, both of United Kingdom

[73] Assignee: Eastman Kodak Company, Rochester, N.Y.

[21] Appl. No.: 816,283

[22] Filed: Mar. 13, 1997

[30] Foreign Application Priority Data

Mar. 13, 1996 [GB] United Kingdom ..... 9605246

[51] Int. Cl.[6] ..... G03C 7/44

[52] U.S. Cl. ..... 430/399; 430/398; 430/467

[58] Field of Search ..... 430/373, 398, 430/399, 467

[56] References Cited

U.S. PATENT DOCUMENTS

| | | | |
|---|---|---|---|
| 4,130,485 | 12/1978 | Dyer et al. | 210/66 |
| 4,816,384 | 3/1989 | Fruge et al. | 430/465 |
| 5,200,301 | 4/1993 | Wingender et al. | 430/373 |
| 5,334,492 | 8/1994 | Wernicke et al. | 430/465 |
| 5,336,588 | 8/1994 | Veda | 430/465 |
| 5,452,045 | 9/1995 | Koboshi et al. | 430/398 |
| 5,480,768 | 1/1996 | Ishida et al. | 430/398 |
| 5,556,736 | 9/1996 | Haraguchi et al. | 430/399 |
| 5,587,277 | 12/1996 | Yamashita et al. | 430/465 |
| 5,629,139 | 5/1997 | Twist | 430/373 |

FOREIGN PATENT DOCUMENTS

| | | |
|---|---|---|
| 0 635 759 A1 | 7/1993 | European Pat. Off. . |
| 2 386 600 | 3/1978 | France . |
| 26 46 807 | 10/1976 | Germany . |

*Primary Examiner*—Hoa Van Le
*Attorney, Agent, or Firm*—J. Lanny Tucker

[57] ABSTRACT

A photographic aqueous processing solution containing at least one solid compound that has a maximum solubility therein corresponding to a desired operating level, which solution is kept in equilibrium with the solid form of the compound, thus maintaining its concentration at the desired level without the need for a replenishing system.

10 Claims, No Drawings

PHOTOGRAPHIC PROCESSING SOLUTIONS

FIELD OF THE INVENTION

This invention relates to photographic processing solutions and in particular, to the control of the concentration of components therein.

BACKGROUND OF THE INVENTION

In photographic processing solutions, the concentrations of the various components need to be kept close to certain aim levels. The normal way to maintain chemical levels is to replenish the components at the same rate as they are consumed. Consumption rates vary with exposure (and hence the amount of silver developed), and losses due to aerial oxidation, evaporation, etc., can vary widely for different processes and processing machines. Even with a particular machine and process, simply replenishing at a calculated rate can lead to undesirable variability. It is normal for processing chemicals to be as soluble as possible to facilitate solution preparation.

The problem to be solved is how to maintain the desired concentration of a processing solution component in a simple but accurate way.

SUMMARY OF THE INVENTION

According to the present invention there is provided a photographic processing solution containing at least one compound that has a maximum solubility therein corresponding to a desired operating level, which solution is kept in equilibrium with the solid form of the compound thus maintaining its concentration at the desired operating level.

This invention also provides a method for processing a photographic material by contacting it with the photographic processing solution described above.

The concentration of the dissolved solid compound in the photographic processing solution is maintained at the desired level regardless of degree of consumption, evaporation, aerial oxidation or other deterioration.

A desired level of, for example, an antioxidant can be maintained automatically without any need to take account of the consumption rate if the solubility is limited to, say, 0.06 molar or some other effective level. This means that the system can be used universally regardless of high or low utilization conditions.

In addition, another benefit has been found in that lower dissolved levels of antioxidant than those in which a more soluble antioxidant would normally be useable are advantageous because the solid material is oxidized by the air at a lower rate than that in solution.

The process does not require replenishment pumps nor any expertise to keep it within control limits. However, other processing solution compounds will, of course, still need replenishment.

DETAILED DESCRIPTION OF THE INVENTION

The principle of using a solid dissolvable compound that slowly dissolves in a solution for replenishment by virture of an approximately controlled dissolution rate is known. In this invention, the principle is specific limited solubility. In the former case, the dissolution rate is not related to the final solubility of the compound involved and so the level is not related to the level in solution at any one time. In this invention, the compound level in the solution determines how much more of the solid compound will dissolve up to the point of maximum solubility, which is set as the operating level or the highest operating level.

The solid compound may be kept in a filter housing or in some similar containment device through which the solution circulates, or it may be located elsewhere, e.g., in the processing tank or a supply tank.

In order to assist dissolution of the solid compound in the processing solution, a "solvent bridge" material may be employed. Hence, the processing solution may contain a solvent for the solid compound. The solvents may be water-miscible or non-water-miscible. Examples of such solvents include an organic alcohol, ketone or ester, and preferably isopropanol or cyclohexanone.

It is envisaged that the solid compound could be color or black-and-white developing agents, auxiliary developing agents or electron transfer agents such as pyrazolidinones, or other components such as antioxidants, such as substituted hydroxylamines. In the field of color image formation by a redox amplification (RX) process, sparingly soluble sources of RX oxidants such as peroxy or other compounds (such as hydrogen peroxide) as well as antioxidants such as substituted hydroxylamines could be used as the solid component.

Of the substituted hydroxylamines, the commonly used ones have a relatively high solubility. Diethyl hydroxylamine, for example, is essentially miscible in all proportions with water and is used from concentrated solutions of 85% or 97%. This material and all other photographic antioxidants used commercially are much too soluble to be used for the present invention. Less soluble derivatives of hydroxylamine that are commercially available such as mono-t-butyl-hydroxylamine are also too soluble. On the other hand, dibenzyl-hydroxylamine is commercially available but is almost entirely insoluble in water even with the assistance of surfactants.

A preferred group of substituted hydroxylamines is the alkyl and cycloalkyl substituted hydroxylamines with straight or branched chain alkyl groups having from 5 to 8 carbon atoms to give a solubility of up to 0.06 molar for example:

n-pentylhydroxylamine
iso-pentylhydroxylamine
N-ethyl-N-propylhydroxylamine
hexylhydroxylamine
cyclohexylhydroxylamine
N,N-dipropylhydroxylamine
heptylhydroxylamine
octylhydroxylamine
hydroxyoctylhydroxylamine
hydroxynonylhydroxylamine
hydroxydecylhydroxylamine
carboxydecylhydroxylamine.

The above hydroxylamine compounds may be further substituted with hydrophilic (e.g., carboxy or sulfo) and/or hydrophobic groups such that the desired solubility is obtained.

Mono-N-cyclohexylhydroxylamine(MCH) has a solubility of about 3.9 to 4 g/l at developer pH (10.0) or about 0.026 molar and is at a level needed for effective use. Another compound that may be used is 4,5-dihydroxylamino-2-propylamino-1,3,5-triazine (CSD).

Diethylhydroxylamine and its sulfonated derivatives, such as disulfodiethylhydroxylamine, are used in current commercial formulations from close to zero up to some 0.06 molar. It is estimated that mono alkyl substituents comprising between 5 and 8 carbon atoms would cover the range from almost zero solubility up to 0.06 molar as the maximum solubility of the antioxidant. It is clear that a maximum solubility of about 0.06 molar could be achieved by a multitude of combinations of substituents comprising hydrophobic and hydrophilic groups. This is a highly desirable practical range.

The cyclic derivative of hydroxylamine (3) referred to above as CSD with lower solubility (between 0.5 and 1 g/l or about 0.005 molar) than cyclohexyl-hydroxylamine was synthesized and its method of synthesis is described below.

Preparation of 4,6-dichloro-2-propylamino-1,3,5-triazine (2)

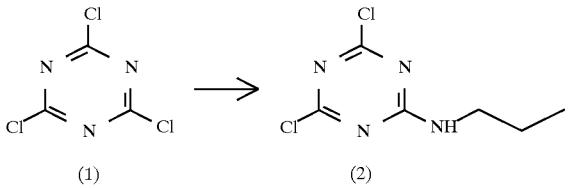

Cyanuric chloride (1) (36.9 g, 0.2 mole) was dissolved in acetone (600 ml) and cooled in an ice/acetone bath. Potassium hydrogen carbonate (25.03 g, 0.25 mole) was dissolved in water (150 ml) with propylamine (11.82 g, 0.2 mole) and added dropwise to the solution of (1) while maintaining the temperature below 0° C. The mixture was stirred for 1 hour at 0° C. and then stirred for 1 hour at room temperature. The acetone was evaporated off under reduced pressure and the residue (300 ml) was poured into water (11). The resulting white solid was filtered, washed with water and dried under vacuum.

Yield=38.2 g (92%).

The product had nmr, mass and ir spectra that were consistent with the proposed structure.

Preparation of 4,5-dihydroxylamino-2-propylamino-1,3,5-triazine (3)

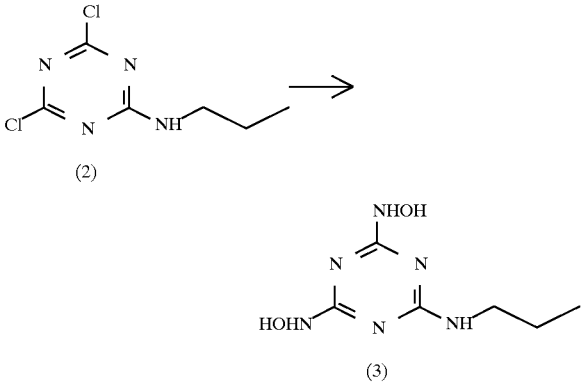

Hydroxylamine hydrochloride (120.0 g, 1.73 mole) was dissolved in water (250 ml). Sodium hydroxide (62.5 g, 1.563 mole) was dissolved in water (175 ml) and slowly added to the first solution while maintaining the temperature below 20° C. by means of an ice/acetone bath. Compound (2) (38.1 g, 0.184 mole) was dissolved in 1,4-dioxane (250 ml) and the aqueous mixture was added dropwise to this while maintaining the temperature below 15° C. On completion of the addition, a pale purple-colored, waxy precipitate was formed. The mixture was heated to 60° C. for 1 hour then to reflux for a further 3 hours. The mixture was cooled and poured into water (11) and left overnight. The mixture was extracted with diethyl ether (total of 31 that was discarded) and the aqueous layer left standing for 72 hours. The resulting precipitate was filtered, washed with water and dried under vacuum.

Yield=12.1 g (33%).

The product had nmr, mass and ir spectra that were consistent with the proposed structure.

Examples of other types of the compounds having limited solubility are color and black-and-white developing agents. Specific examples are listed below:

(a) Color developing agents

These need to be in the solubility range of from 0 to about 0.015 molar or 6.5 g/l of a commonly used color developing agent such as CD3 (methyl sulfonamidoethyl ethylamino toluidine sesquisulfate hydrate). This agent is however soluble to about 12 g/l or 0.028 molar, that is, about twice its normal upper operating limit, and so does not fall within the scope of the present invention. The following color developing agents have suitably lower solubilities:

N,N-diethyl-p-phenylenediamine
N,N-diethyl-3-methyl-p-phenylenediamine
N,N-dipropyl-p-phenylenediamine
N,N-dipropyl-3-methyl-p-phenylenediamine
N,N-dihydroxypropyl-3-methyl-p-phenylenediamine (b) Black-and-White developing agents These are used usually within the range of from 0 to 0.01 molar or about 2 g/l of a commonly used auxiliary developing agent such as 4,4-dimethyl-1-phenyl-3-pyrazolidone that would come within the scope of the present invention but at the higher solubility limit. The following compounds have suitable lower solubilities:

4-ethyl-1-phenyl-3-pyrazolidone
4,4-dimethyl-1-phenyl-3-pyrazolidone
4,4-diethyl-1-phenyl-3-pyrazolidone
4-n-pentyl-1-phenyl-3-pyrazolidone
4-hydroxypentyl-1-phenyl-3-pyrazolidone
4,4-dimethyl-1-phenyl-4'-methyl-3-pyrazolidone
4-n-pentyl-1-phenyl-4'-methoxy-3-pyrazolidone.

The processing solutions and photographic material processed thereby may be any of those described in *Research Disclosure*, Item 36544, September 1994, Sections XVII to XX, published by Kenneth Mason Publications, Emsworth, Hants, United Kingdom.

The following Examples are included for a better understanding of the invention.

EXAMPLE 1

A circulation system of about 500 ml capacity was set up in which solid N-monocyclohexyl hydroxylamine (MCH) was retained behind a removable filter paper filter. The solution circulated was potassium carbonate at pH=10.5. The solution was left to circulate for 30 minutes and the amount of MCH in solution was determined by removing the paper filter that retained the MCH, drying and weighing it. This gave the amount of solid not in solution and hence, by difference from that on the filter initially, the amount in solution. An extra volume of potassium carbonate solution that did not contain MCH was added to the system and after 30 minutes the amount of MCH in solution was determined. The volume was increased by increments of 10%. In a second part of the experiment most of the solution was removed from the system and evaporated to reduce its volume, again in increments of 10%. Solid MCH came out of solution and was collected on the filter and weighed as before. The amount of MCH in solution during this dilution or evaporation procedure is shown in Table 1.

TABLE 1

Equilibrium Levels of N-cyclohexyl hydroxylamine

| Volume % Relative to initial | MCH in Solution |
|---|---|
| 150 | 3.96 g/l |
| 140 | 4.05 g/1 |
| 130 | 4.11 g/l |
| 120 | 3.87 g/l |
| 110 | 3.81 g/l |
| 100 | 3.80 g/l |
| 90 | 3.88 g/l |
| 80 | 3.92 g/l |
| 70 | 4.03 g/l |

This shows that regardless of any dilution that might occur by addition of a replenisher solution that did not contain MCH or loss of volume by evaporation, the level of MCH automatically adjusted itself to the initial level within 30 minutes.

EXAMPLE 2

The compounds CSD and MCH were compared with diethyl hydroxylamine at equimolar levels in a developer of the composition shown in Table 2.

TABLE 2

Developer Composition

| Component | Concentration |
|---|---|
| AC5 | 0.6 g/l |
| $K_2CO_3$ | 25 g/l |
| KBr | 28 mg/l |
| KCl | 6.0 g/l |
| TEA (85%) | 5.5 ml/l |
| REU | 1.0 g/l |
| Antioxidant | see below. |
| CD3 | 4.35 g/l |
| pH | 10.05 |

Where AC5 is a 60% W/W solution of 1-hydroxyethylidene-1,1-diphosphonic acid. TEA is an 85% solution of triethanolamine in water. REU is a commercially available optical brightener called PHORWITE™REU. CD3 is N-[2-(4-amino-N-ethyl-m-toluidino) ethyl]-methanesulfonamide sesquisulfate hydrate.

The antioxidant level was equivalent to 3.0 ml/l diethyl hydroxylamine(85%); which is about 0.029 molar. The three developers were as follows;

| Developer | Antioxidant | Amount |
|---|---|---|
| Dev 1 (Control) | diethyl hydroxylamine (85%) | 3 ml/l |
| Dev 2 (Inv.) | CSD (Mwt 200.2) | 5.73 g/l |
| Dev 3 (Inv.) | mono-N-cyclohexyl-hydroxylamine hydrochloride | 4.34 g/l |

These developers were placed in 500 ml measuring cylinders and stirred continuously with magnetic stirrers to create a vortex depth of about 5 mm in each case in order to ensure continuous aeration. The diethyl hydroxylamine was completely in solution. CSD was about 10 to 15% in solution. The rest was a solid swirling in the solution. About 90% of the N-cyclohexyl hydroxylamine was in solution with the rest as a solid swirling in solution. Samples were taken each day and analyzed for CD3 content. The results are shown in Table 3 below.

TABLE 3

Limited Solubility Antioxidants

| Age | CD3 concentration (g/l) | | |
|---|---|---|---|
| (weeks) | Dev 1 | Dev 2 | Dev 3 |
| 0 | 4.5 | 4.4 | 4.3 |
| 1 | 3.4 | 4.3 | 3.9 |
| 2 | 2.1 | 3.7 | 2.8 |
| 3 | 0.8 | 3.2 | 2.0 |
| 4 | 0 | 2.8 | 1.5 |
| 5 | 0 | 2.3 | 1.2 |

It can be seen that the control developer has lost all its CD3 in just over 3 weeks whereas Dev 2 has lost only 30% and Dev 3 about 60%. It is interesting that the developer that had the least concentration of antioxidant at any one time, Dev 2, was the best preserved. This is an unexpected and additional benefit of the invention. It appears that while the antioxidant is in its solid form it is not itself oxidized by the air and so is able to maintain a reservoir of potentially active material. The control developer that contains the same molar amount of antioxidant will be prone to loss of antioxidant not only in preserving the color developing agent but also by direct aerial oxidation. Developer 3 shows behavior intermediate between the other two as reflects its intermediate solubility. Thus, it appears that limited solubility antioxidants are not only capable of maintaining a desired level automatically, independent of usage rate(since this level is equal to the maximum solubility), but also they can be used at lower dissolved levels because they are continuously replaced from the solid source and while in the solid phase are oxidized by the air at a lower rate.

The invention has been described in detail with particular reference to preferred embodiments thereof, but it will be understood that variations and modifications can be effected within the spirit and scope of the invention.

We claim:

1. A photographic aqueous processing solution containing at least one solid compound that is always present, and has a maximum solubility therein corresponding to a desired operating concentration, which solution is kept in equilibrium with said solid compound thus maintaining its concentration at said desired operating concentration, wherein said solid compound is:

a color developing agent having a maximum solubility of from 0.001 to 0.06 molar.

2. The processing solution of claim 1 further containing a solvent for the said solid compound.

3. The processing solution of claim 2 wherein said solvent is an organic alcohol, ketone or ester.

4. The processing solution of claim 1 wherein the solubility of said solid compound is from 0.01 to 0.06 molar.

5. The processing solution of claim 1 wherein said solid compound is a color developing agent that is N,N-diethyl-p-phenylenediamine, N,N-diethyl-3-methyl-p-phenylenediamine, N,N-dipropyl-p-phenylenediamine, N,N-dipropyl-3-methyl-p-phenylenediamine or N,N-dihydroxypropyl-3-methyl-p-phenylenediamine.

6. The processing solution of claim 3 wherein said solvent is isopropanol or cyclohexanone.

7. The processing solution of claim 1 wherein the maximum solubility of said color developing agent is up to 0.015 molar.

8. A method of processing an imagewise exposed photographic material comprising contacting it with a photographic aqueous processing solution containing at least one solid compound that is always present, and has a maximum solubility therein corresponding to a desired operating concentration, which solution is kept in equilibrium with said solid compound thus maintaining its concentration at said desired operating concentration, wherein said solid compound is a color developing agent having a maximum solubility of from 0.001 to 0.06 molar.

9. The method of claim 8 wherein said processing solution is recirculated through a containment device containing said solid compound.

10. The method of claim 9 wherein said containment device is a filter housing containing a filter.

* * * * *